United States Patent [19]

Proctor

[11] 4,233,925

[45] Nov. 18, 1980

[54] PADDLES FOR BOATS

[76] Inventor: Douglas B. I. Proctor, "Fenmead", Brook Ave., Warsash, Hampshire, England

[21] Appl. No.: 13,561

[22] Filed: Feb. 21, 1979

[30] Foreign Application Priority Data

Feb. 23, 1978 [GB] United Kingdom ..... 7259/78

[51] Int. Cl.[3] ..... B63H 16/04

[52] U.S. Cl. ..... 440/101; 9/307; 416/70 R

[58] Field of Search ..... 416/69, 70 R; 9/303–309; 272/1 B, 71; 35/29 B; 264/553, 554; 115/24.1

[56] References Cited

U.S. PATENT DOCUMENTS

| | | | |
|---|---|---|---|
| 242,773 | 6/1881 | Hayes | 9/307 |
| 2,745,119 | 5/1956 | Whipple | 9/307 |
| 2,941,218 | 6/1960 | Read | 9/307 |
| 3,039,120 | 6/1962 | Powell et al. | 9/307 |
| 3,810,269 | 5/1974 | Tabata et al. | 9/307 |

*Primary Examiner*—Sherman D. Basinger

*Attorney, Agent, or Firm*—McCormick, Paulding & Huber

[57] ABSTRACT

A plastic paddle of unitary construction defining a hand grip with a wrist engageable portion at one end, and a blade portion at the opposite end, which blade has a tapered cross sectional shape with flanges defined along its marginal edges to achieve maximum strength from a minimum material, and the paddle material itself being formed of plastic to a uniform thickness for economy in manufacture.

7 Claims, 9 Drawing Figures

PADDLES FOR BOATS

This invention relates to paddles and is particularly concerned with single-handed paddles for use with boats. Shallow draft boats and similar craft, such as rafts, and particularly shallow draft sailing boats, are notoriously difficult to steer when being propelled by one hand-held paddle of the usual type-that is a paddle having a blade portion and a gripping portion, such as a shaft, that is intended to be held by both hands of a user. Directional control of the boat is particularly difficult with only one person aboard as, with both hands on the paddle, the user has no hand to spare for steering by means of a tiller and rudder.

Hand aids which increase the area for propulsion have been proposed for swimmers, for example in French Pat. No. 528,934 which provides an elongate piece of material with a narrow slot part-way along its length and a flexible strap at one end through which the arm of a user is inserted before passing the fingers through the slot. A disadvantage of this device is the necessity for a second manufacturing procedure to locate the strap. The strap prevents pivoting of the aid about the hand-grip and is non-adjustable and tight on the forearm. Difficulty is foreseen in using the aid as a boat paddle since normally a sailor will be wearing a sleeve and may have difficulty in threading his arm through the strap. A strap which engages bare skin would have a tendency to chafe when wet. The aid of French Pat. No. 528,934 is specifically proposed for use when swimming on one's back, and hand aids have been proposed for swimming on the front, particularly in German Pat. No. 2,322,058 and in U.S. Pat. No. 2,745,119. Such devices tend to include a hand engaging part and a blade part, the latter being at least as broad as, and usually broader than, it is long for the reason that if the blade were made longer, as is necessary for a boat paddle, the device would be out of balance and could not be held during the complete cycle of a swimming stroke, particularly as it is usual to swim with the hand open. A long blade would make normal forward swimming strokes extremely difficult. Both the devices disclosed in the German Pat. No. 2,322,058 and the U.S. Pat. No. 2,745,119 have large areas for water engagement in the hand-receiving part which limit the twisting of the devices about the hand by balancing the propulsion forces on the blade and which, in the German Patent, permit an open-handed use of the device with a flexible wrist brace of limited strength. In the U.S. Patent this lack of twist enables minimal finger gripping, as shown, by the small finger apertures which allow only the fingertips to be used for gripping. In both Patents it is the palm of the hand which provides the force for propulsion and it is believed that this provides great discomfort when there is substantial twisting force about the hand-grip as in the case of a boat paddle, where the hand and the hand-receiving part are not generally intended to enter the water.

In the U.S. Pat. No. 2,745,199 the longitudinal extent of the palm bearing surface towards the lower arm brace requires that the brace stands well proud of the plane of the blade, as does the hand-grip in the German Pat. No. 2,322,058, and this provides a storage problem for such devices which may be used on boats where space is limited particularly since ropes and lines are liable to catch on them.

It is a general object of the present invention to provide a paddle, for use primarily with boats, which can be easily formed in plastics material in one manufacturing process, can be comfortably used with only the blade-part of the paddle immersed and can be conveniently stowed on a small boat.

According to the present invention there is provided a paddle of rigid unitary construction formed in plastics material, for use with boats, and consisting of a hand-receiving portion forming one end-part of the paddle, a longitudinally extending generally planar blade portion of substantially greater length than width forming the other end-part and laterally spaced side members extending longitudinally from the blade portion into the hand-receiving portion; a rigid lateral hand-grip that is relatively narrow in the longitudinal direction spanning the side members at a position longitudinally spaced from the blade portion between the ends of the paddle to define a first aperture between the side members, the blade portion and the hand-grip whereby a hand may be curled around the grip; a rigid lateral bracing portion spanning the ends of the side members remote from the blade portion in longitudinally spaced manner from the hand-grip to define a second aperture between the hand-grip, the bracing portion and the side members, both the bracing portion and the hand-grip lying generally in the principal plane of the blade portion, whereby in use with the fingers of one hand curled around the hand-grip, the hand extends through the second aperture with the lower arm bearing against the bracing portion to restrain the paddle against pivotal movement within the grip while the blade portion is subjected to pressure during propulsion.

The blade portion of the paddle is preferably made relatively thin to minimise the quantity of plastics material used in manufacture and in order to retain the strength of the blade portion the side members may extend longitudinally into the blade portion to define side walls therein which are disposed in respective planes lying generally transversely to the principal plane of the blade portion. The principal plane of the blade portion is that which includes the blade portion and which extends in the x- and z- directions relative to the blade (i.e. longitudinally and laterally thereof) for the maximum thickness of the blade portion. Conveniently, the said side walls in the blade portion taper in height from adjacent the first aperture to the remote end of the blade portion, and the said remote end may be made substantially flat with square corners to facilitate use of the paddle as a water scoop, the water being collected between the side walls.

Since the paddle of the present invention defines a substantially planar shape it may be conveniently stowed on board a boat against a flat surface with no great risk of snagging ropes. To further facilitate stowage, flange portions may extend laterally outwardly in one plane from the side members in both the hand-receiving portion and the blade portion to define a flat surface which may engage a corresponding flat surface on, for example, the boat. The flat surface of the flange portions is preferably parallel to and within the principal plane of the blade portion. The flange portions may receive, for example, turnbuttons to secure the paddle in a stowed position.

The paddle should float in water and may be injection moulded in, for example, polyurethane (particularly self-skinning PU foam), nylon or polypropylene or, for example, it may be vacuum formed in ABS or moulded in GRP, preferably in a colour which is easily discernible at sea or on the water.

One embodiment of a paddle primarily for use with boats and in accordance with the present invention will now be described by way of example only, with reference to the accompanying drawings, in which.

Figure 7:
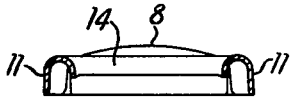
FIGS. 7 and 8 are sectional views on the lines Y—Y and Z—Z respectively of FIG. 3.

The boat paddle illustrated in the drawings is of a generally planar design, facilitating safe stowage on a boat, and allows injection moulding thereof in a suitable thermoplastics material such as polypropylene or nylon so that it floats in water. The paddle comprises a longitudinally extending, generally planar blade portion 1 and a hand-receiving portion 2 that are integrally formed, and is partly defined by opposed parallel longitudinally extending side members 3, each side member portion 11 in the hand-receiving portion 2 extending longitudinally from the blade portion 1 and, for a substantial part of its length, comprising a pair of spaced parallel side walls which are joined to provide a U-shape cross-section (FIG. 7), the said side walls being disposed generally transverse to the principal plane of the blade portion 1. The principal plane of the blade portion 1 extends longitudinally and laterally of the blade portion through the maximum thickness thereof. The double side walls in the portions 11 of the side members 3 provide additional strength to the paddle in the hand-receiving portion.

Figure 6:
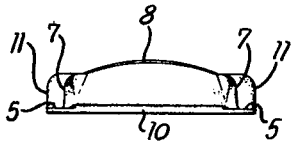
FIG. 6 is an end view of the paddle taken from the blade end.
Figure 8:
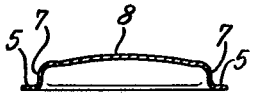

The blade portion 1 is substantially longer than it is wide to facilitate use from a boat and comprises portions 7 of the longitudinally extending side members 3, which portions are disposed in respective planes substantially normal or transverse to the principal plane of the blade portion, the side member portions 7 being bridged by a blade 8. The side member portions 7 taper in height from the end 9 thereof adjacent the hand-receiving portion 2 of the paddle to the remote end 10. The remote end 10 of the blade portion 1 is substantially flat and is provided with generally square corners. The blade 8 has a slight concave cross-section (shown in FIGS. 6, 7 and 8) (in the direction opposite to the direction of movement of the paddle during a propelling stroke—see FIG. 9) which may serve to increase the rigidity of the blade portion 1 and the depth of which progressively decreases towards the remote end 10. The general shape of the blade portion 1 is such that the paddle may be used to scoop water from a waterlogged boat.

The outer pair of side walls in the portions 11 of the longitudinally extending side members 3 are integral with respective side member portions 7. At the end 12 of the hand-receiving portion 2 remote from the blade portion 1, the side member portions 11 are bridged by a substantially rigid lateral bracing piece 13 whose cross-section is also concave to comfortably receive a wrist or lower forearm. Spanning the side member portions 11 at a position remote from both the blade portion 1 and the bracing piece 13 is a rigid lateral hand-grip 14 which partly defines, with the blade portion 1 and side wall portions 11, a first aperture 15 and, with the bracing piece 13 and the side wall portions 11, a second aperture 16. The hand-grip 14 is integrally formed with the inner pair of side walls in the portion 11 of the side members 3 and is relatively narrow in the longitudinal direction to permit the hand of a user to be comfortably curled around and back under it with the thumb extending under the hand-grip. Both the hand-grip 14 and lateral bracing portion 13 extend generally in the principal plane of the blade portion 1 to facilitate stowage in a small boat and to ensure comfortable usage (FIG. 9), while at the same time alleviating the likelihood of ropes, etc. being caught around those parts when the paddle is stowed against a substantially flat surface.

Figure 3:
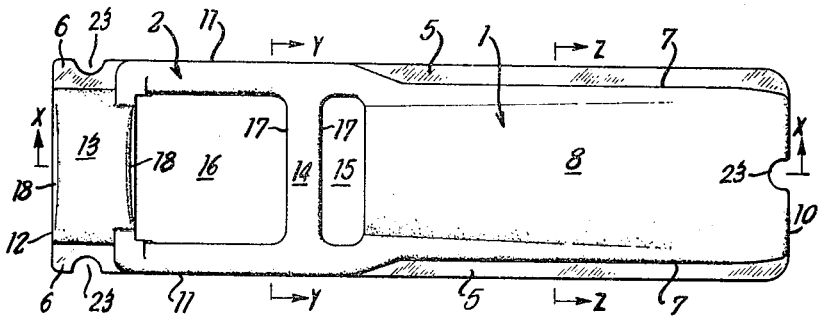
FIG. 3 is a plan view from above of the paddle of FIG. 1.
Figure 5:
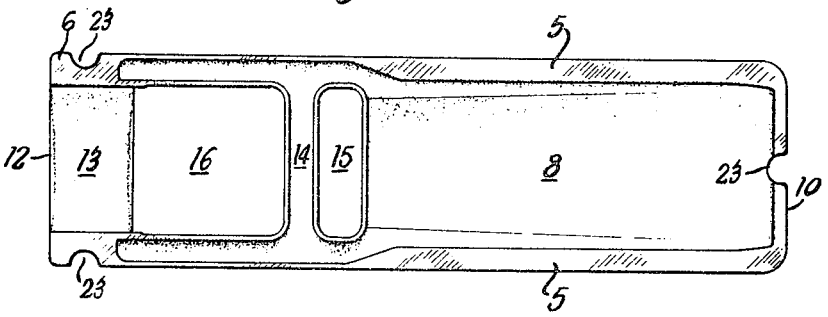
FIG. 5 is a plan view from below of the paddle of FIG. 1.

The paddle is formed so that its base 4 defines a planar surface that is parallel to and within the principal plane of the blade portion to enable stowage against a flat surface. Extending laterally outwardly from the side members 3 are first flange sections 5 in the blade portion 1 and second flange sections 6 in the hand-receiving portion 2, which partly define the base 4. All of the flange sections 5 and 6 extend in the principal plane of the blade portion and provide upper surfaces which can receive locking means (not shown), such as turnbuttons, when the paddle is stowed against the flat surface. Optionally, and as shown in FIGS. 3 and 5, notches 23 are provided in the flange sections 6 and in the remote end 10 of the blade portion 1 to receive retaining means (not shown), such as screws with large flat heads, when the paddle is stowed and thereby firmly hold the paddle when it is placed behind the head of the screws, which may be readily achieved by slightly flexing the bracing piece 13.

Figure 9:
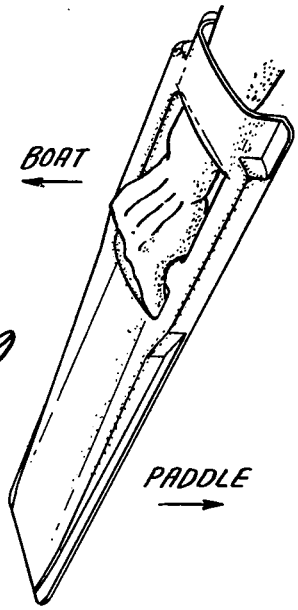
FIG. 9 illustrates use of the paddle.

In use of the paddle, as shown in FIG. 9, the hand of a user is passed through the second aperture 15 so that the back of the wrist or lower forearm bears against the concave bracing piece 13 in a convenient, efficient and comfortable manner, whether the arm is bare or clothed. The fingers of that hand are then curled over and fully around the hand-grip 14 through the first aperture 15 while the thumb passes under the hand-grip, so that the paddle is firmly gripped and forms a substantially rigid extension of the lower forearm. Alternatively, the fingers of the one hand may be passed initially through the first aperture 15 and curled around the hand-grip so that they enter the second aperture 16, with the front of the lower forearm or wrist bearing against the bracing piece 13. The hand-grip 14 and bracing piece 13 may be made more comfortable to the user by rounding-off edges, such as at 17, on the hand-grip, by providing upstanding lips 18 on the bracing piece 13, and, for example, by providing finger-grooves (not shown) on the hand-piece. Cushioning may also be provided on one or both of the bracing piece 13 and the hand-grip 14. The paddle of the present invention permits the hand-grip to be grasped under the first joint of the fingers so that the major forces during propulsion are through those joints and the metacarpals of the fingers, as opposed to through the palm of the hand, while the blade portion is sufficiently long that the hand does not have to be immersed during propulsion of the boat.

Figure 4:
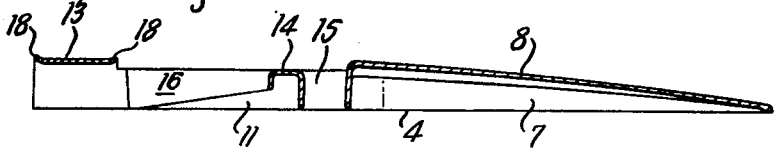
FIG. 4 is a sectional view of the paddle taken on the line X—X of FIG. 3.

In use of the paddle for scooping water from, for example, a waterlogged boat, the paddle is held as for normal use in paddling with the outer surface of the blade 8 facing downwardly towards the surface supporting the water. The blade portion 1 of the paddle is immersed in the water and water flows into the scoop defined by the side walls 7, the remote end 10 and the end wall of the blade portion 1 at the end 9—shown best in FIGS. 1 and 4. The generally flat remote end 10 enables shallow water to be scooped up. The weight of the water in the blade portion will tend to balance the paddle in use as a scoop with the bracing portion 13 engaging the lower forearm, but if desired the paddle may be used as a scoop with two hands, one engaging the hand-grip 14 and the other hand engaging the bracing portion 13.

Figure 1:
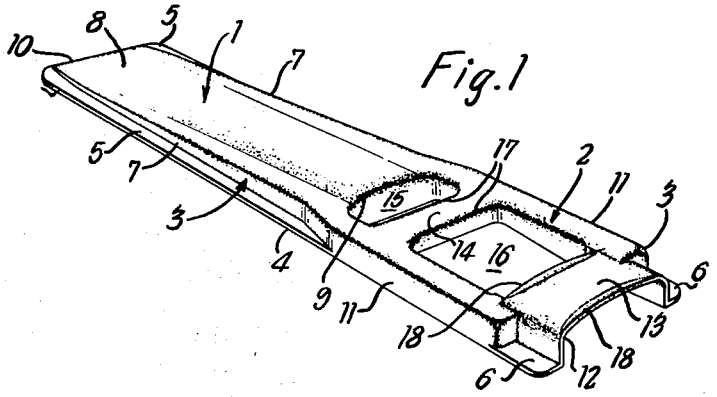
FIG. 1 is a perspective view of a first embodiment of the paddle.
Figure 2:
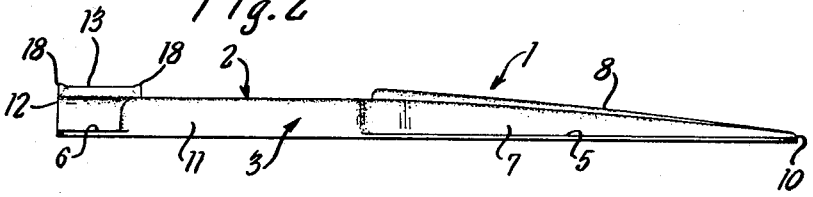
FIG. 2 is a side view of the paddle of FIG. 1.

In order to minimise inconvenience of the paddle when it is stowed, the flange portions 5 and 6 do not project outwardly beyond the maximum lateral spacing of the side members 3. This is provided for in the blade portion 1 by flaring the side members inwardly at the junction between the side member portions 7 and the outer pair of side walls in the side member portions 11. In the hand-receiving portion 2, the bracing portion 13 is integrally formed with the inner pair of side walls in the side member portions 11 and the outer pair of side walls extend for only a part-length of the bracing portion 13, to give sufficient strength thereto while enabling the flange portions 6 to extend laterally outwardly from the inner pair of side walls. In FIGS. 1 and 3 it may be seen that the height of the inner pair of side walls in the side member portions 11 tapers from the bracing portion 13 to the hand-grip 14, thereby sufficiently strengthening the hand-receiving portion while allowing the thumb of the user to be comfortably passed under the hand-grip with the fingers extending thereover.

It will be appreciated that many modifications may be made to the aforedescribed preferred embodiment of the present invention without passing outside the following claims and at the same time retaining the major advantages of the invention over the aforementioned prior proposals.

I claim:

1. A paddle of rigid unitary construction formed in plastics material, for use with boats, and consisting of a hand-receiving portion forming one end-part of the paddle, a longitudinally extending generally planar blade portion of substantially greater length than width forming the other end-part and laterally spaced walls extending longitudinally in both the blade portion and the hand-receiving portion, the side walls having lower edges which lie in a plane defining the base of the paddle and being disposed generally transversely to said plane; a rigid lateral hand-grip that is relatively narrow in the longitudinal direction spanning the side walls at a position longitudinally spaced from the blade portion between the ends of the paddle to define a first aperture between the side walls, the blade portion and the hand-grip whereby a hand may be curled around the grip; a rigid lateral bracing portion spanning the ends of the side walls remote from the blade portion in longitudinally spaced manner from the hand-grip to define a second aperture between the hand-grip, the bracing portion and the side walls, both the bracing portion and the hand-grip lying generally in the extended principal plane of the blade portion whereby in use with the fingers of one hand curled around the hand-grip, the hand extends through the second aperture with the lower arm bearing against the bracing portion to restrain the paddle against pivotal movement with the grip while the blade portion is subjected to pressure during propulsion, and wherein in the blade portion extends across the side walls from upper portions thereof and longitudinally from a position adjacent the first aperture to the remote end of the blade portion, the side walls in the blade portion tapering in height from said position adjacent the first aperture to the remote end of the blade portion whereby the end of the blade at the remote end of the blade portion extends in the plane defining the base of the paddle with said end substantially perpendicular to the side walls, and a lateral wall disposed generally transversely to said base plane between the side walls and extending from the blade adjacent the first aperture to a lower edge thereof in said base plane such that a water scoop is defined between the remote end of the blade, the lateral wall and the side walls in the blade portion.

2. A paddle according to claim 1 wherein each side wall in the hand-receiving portion comprises a pair of spaced parallel side walls which are joined at upper portions and disposed generally transversely to the principal plane of the blade portion.

3. A paddle according to claim 1 wherein flange portions extend outwardly in the base plane from the side walls in both the hand-receiving portion and the blade portion to define a flat surface which may engage a corresponding flat surface to facilitate stowage of the paddle.

4. A paddle according to claim 3 wherein notches are formed in one or more of the flange portions and/or in the remote end of the blade portion to facilitate engagement by retaining means during stowage.

5. A paddle according to claim 1 wherein the blade is of slight laterally concave form in the direction opposite to the direction of movement of the paddle during a propelling stroke, and wherein the depth of the concavity decreases from adjacent the first aperture to the remote end of the blade portion.

6. A paddle according to claim 1 wherein the edges of the hand-grip to be gripped are rounded for comfort.

7. A paddle according to claim 1 wherein the bracing portion is of laterally concave form to generally correspond in shape to the lower fore-arm, and upstanding lips are provided on the laterally-extending edges of said concave part of the bracing portion to alleviate rubbing of the said edges against the skin during use.

* * * * *

UNITED STATES PATENT AND TRADEMARK OFFICE

CERTIFICATE OF CORRECTION

PATENT NO. : 4,233,925

DATED : November 18, 1980

INVENTOR(S) : Douglas B.I. Proctor

It is certified that error appears in the above-identified patent and that said Letters Patent are hereby corrected as shown below:

Column 1, line 61, delete "2,745,199" and substitute --2,745,119--.

Column 6, line 13, after "portion" insert --a blade--.

Signed and Sealed this

*Seventeenth* Day of *March 1981*

[SEAL]

*Attest:*

RENE D. TEGTMEYER

*Attesting Officer*

*Acting Commissioner of Patents and Trademarks*